US006694886B1

(12) United States Patent
Woodall et al.

(10) Patent No.: US 6,694,886 B1
(45) Date of Patent: Feb. 24, 2004

(54) RIGID REACTIVE CORD AND METHODS OF USE AND MANUFACTURE

(75) Inventors: Mark E. Woodall, Greenville, KY (US); Dennis P. Johnson, Lexington, KY (US); Eric C. Gerst, Evansville, IN (US)

(73) Assignee: The Ensign-Bickford Company, Simsbury, CT (US)

( * ) Notice: Subject to any disclaimer, the term of this patent is extended or adjusted under 35 U.S.C. 154(b) by 0 days.

(21) Appl. No.: 09/645,276

(22) Filed: Aug. 24, 2000

Related U.S. Application Data

(60) Provisional application No. 60/151,558, filed on Aug. 31, 1999.

(51) Int. Cl.[7] ..... C06C 5/00

(52) U.S. Cl. ..... 102/275.1; 102/275.8

(58) Field of Search ..... 102/275.1, 275.2, 102/275.7, 275.8, 275.9, 275.12

(56) References Cited

U.S. PATENT DOCUMENTS

| | | | | | |
|---|---|---|---|---|---|
| 1,917,540 | A | | 7/1933 | Pearsall | |
| 2,311,721 | A | | 2/1943 | Wilson | 102/24 |
| 2,709,407 | A | | 5/1955 | Lowe | 102/24 |
| 3,590,739 | A | * | 7/1971 | Persson | |
| 3,749,021 | A | * | 7/1973 | Burgess | |
| 3,949,673 | A | * | 4/1976 | Lyerly | 86/20 C |
| 4,080,902 | A | * | 3/1978 | Goddard et al. | |
| 4,220,087 | A | * | 9/1980 | Posson | |
| 4,328,753 | A | * | 5/1982 | Kristensen et al. | 102/275.5 |
| 4,374,652 | A | * | 2/1983 | Zahedi et al. | 55/6 |
| 4,432,268 | A | * | 2/1984 | Miller | 86/1 R |
| 4,527,482 | A | * | 7/1985 | Hynes | 102/331 |
| 4,757,764 | A | * | 7/1988 | Thureson et al. | 102/312 |
| 4,757,863 | A | | 7/1988 | Challacombe et al. | 166/299 |
| RE33,202 | E | * | 4/1990 | Janoski | 102/275.3 |
| 5,056,587 | A | | 10/1991 | Jones et al. | 165/1 |
| 5,211,135 | A | | 5/1993 | Correia et al. | 122/379 |
| 5,212,341 | A | * | 5/1993 | Osborne et al. | 102/275.8 |
| 5,481,827 | A | * | 1/1996 | Decker | 47/58 |
| 5,621,070 | A | * | 4/1997 | Howard, Jr. | 528/481 |
| 5,629,493 | A | * | 5/1997 | Andersson et al. | 102/275.8 |
| 5,703,320 | A | | 12/1997 | Lucca et al. | 102/275.7 |
| 5,705,073 | A | * | 1/1998 | Loquenz et al. | 210/631 |
| 5,732,363 | A | * | 3/1998 | Suzuki et al. | 588/4 |
| 5,763,816 | A | * | 6/1998 | Keeling | 102/322 |
| 5,769,034 | A | | 6/1998 | Zilka et al. | 122/379 |
| 5,786,416 | A | * | 7/1998 | Gardner et al. | 102/517 |
| 5,900,322 | A | * | 5/1999 | Buchanan et al. | 428/480 |
| 6,048,379 | A | * | 4/2000 | Bray et al. | 102/517 |

FOREIGN PATENT DOCUMENTS

| | | | | |
|---|---|---|---|---|
| CA | 1200718 | * | 2/1986 | 102/275.8 |

OTHER PUBLICATIONS

The Condensed Chemical Dictionary; Hawley; Eighth Edition, pp. 710–711; Copyright 1971.*

Standard Test Methods for Flexural Properties of Unreinforced and Reinforced Plastics and Electrical Insulating Materials, ASTM Designation D 790–98, American Society for Testing and Materials pp. 1–9 no date.

* cited by examiner

*Primary Examiner*—Stephen M. Johnson
(74) *Attorney, Agent, or Firm*—Libert & Associates; Victor E. Libert; Frederick A. Spaeth

(57) ABSTRACT

The present invention provides a rigid reactive cord such as a detonating cord (10) that includes a core (38) of an energetic material and a rigid non-metal sheath (40) disposed about the core. The cord (10) is sufficiently rigid so that it can be inserted through a material to be fractured or through passages formed therein. A method of using the rigid reactive cord for the removal of combustion residue from boiler tubes is also presented.

29 Claims, 8 Drawing Sheets

RIGID REACTIVE CORD AND METHODS OF USE AND MANUFACTURE

CROSS-REFERENCE TO RELATED APPLICATION

This application claims benefit of U.S. Provisional Application 60/151,558 filed Aug. 31, 1999 now abandoned.

BACKGROUND OF THE INVENTION

1. Field of the Invention

The present invention relates to reactive cords and connectors therefor and, more particularly, to cords which are sufficiently rigid for insertion through a material to be fractured by the cords.

2. Related Art

Detonating cords are well known and typically include a core explosive material covered by a non-metal sheath. The sheath may comprise an extruded flexible plastic inner jacket and a flexible, textile outer jacket composed of, for example, polyester yarn. The detonating cord sheath may also include a waterproofing and sealing material such as asphalt disposed about the core. The core explosive may be composed of, for example, pentaerythritol trinitrate (PETN), cyclonite (RDX), homocyclonite (HMX), tetranitrocarbazol (TNC), hexanitrostilbene (HNS), 2-6-bis picryo-amino 3,5-dinitro pyridine (PYX) or black powder, typically with a plasticizer such as a polysulfide and/or one or more other known additives. A typical core loading of PETN may be on the order of 7.5 to 50 grains per foot (gr/ft) (about 1.6 to 10.6 grams per meter (g/m)) with a detonation velocity of about 21,000 feet per second (about 6400 meters per second) or about 4 miles a second (about 6.4 kilometers per second). Detonating cords are typically used in the initiation of charges of high explosives but have also found other applications, including the removal of combustion residues formed on boiler tubes in steam generation plants as described below. A cross-sectional view of a typical prior art detonating cord 30' produced by the Assignee of this application is shown in FIG. 1A and comprises a core 38 of explosive material, about which a multi-layer, non-metal sheath is disposed. The sheath comprises a thin plastic containment jacket 35 which contains the core material and two layers 31 and 33 of textile casings. The Assignee also produces a detonating cord under the trademark PD CORD. The product is an all-purpose detonating cord comprising an explosive core encased in a textile, which in turn is covered with a plastic jacket. These products remain flexible enough to allow knot tying and spooling of lengths measuring hundreds of feet onto a three-inch diameter spool. A more rigid detonating cord produced by the Assignee is identified by the commercial designation PRIMACORD 400, whose stiffness is a result of its high core load (400 gr/ft) and diameter (about 0.5 inch). Even this product is sufficiently flexible to be wound onto six-inch spools.

Detonating cord as is known in the art is so flexible that it can be tied in knots with other flexible cords for purposes of detonation signal transfer from one to another. The high degree of flexibility of known detonating cord makes it necessary to either lay the cord where desired or pull it into position since it lacks sufficient rigidity to be pushed into place. Like-wise, detonating cord cannot easily be pushed through a small passageway, especially if the passageway is irregular or has bends or kinks, and it cannot be pushed so as to penetrate fly ash or another soft substance for any significant distance.

Steam generation plants generate steam for various uses, e.g., to drive turbines for the generation of electricity or to provide steam to heat large buildings. Such plants typically combust a fuel, e.g., coal, to heat a bank of water-containing boiler tubes to generate the steam. One side product of the combustion is air-borne fly ash, which is typically a mixture of alumina, silica, carbon, hydrocarbons and various metallic oxides. Over time, fly ash, along with other particulates such as dust, builds up and solidifies on the surface of the boiler tubes and may even fill the spaces between the boiler tubes. The fly ash and other residues vary considerably in density from a powdery consistency to a cement-like scale. When such residues cover the boiler tubes, they thermally insulate the tubes from the flames used to heat them and thereby reduce the efficiency of heat transfer and thus the efficiency of the boiler. Accordingly, from time to time, the caked fly ash and other residues must be removed from the banks of boiler tubes in order to return the efficiency of the steam plant to acceptable levels.

Removal of the caked fly ash from a bank of steam or boiler tubes is conventionally carried out by teams of workers, at least one team member standing or crouching on top of the bank of boiler tubes and another team member standing or crouching out of sight under the bank of boiler tubes, which is typically about several feet deep. The work process involves passing a detonating cord through the caked fly ash and around the tubes, and then initiating the detonating cord so that the fly ash and scale are broken up and are dislodged from the tubes. If the fly ash and/or scale leaves sufficient space between the tubes, it may be feasible simply to drop the detonating cord downward between the tubes. However, if the fly ash fills the spaces between the tubes or if the path between the tubes is narrow or irregular because of the fly ash, passages must be created in the caked fly ash to accommodate the detonating cord, which lacks sufficient rigidity to be pushed through the fly ash or to be guided and forced through a narrow or irregular path from above. The process of creating the passages is termed "rodding" and involves the use of, for example, a bar and/or a saw forced between the boiler tubes by hand to create passages through the caked fly ash to receive the detonating cord. The bar and/or saw used is typically about 4 to 6 feet (about 1.2 m to 1.8 m) long in order to cut a passage completely through the caked fly ash on a bank of boiler tubes. This work is physically demanding and is often done in very confined spaces as the distance between banks of boiler tubes within a typical boiler may be as little as about 4 feet (about 1.2 meters). Moreover, many passages must be created as the detonating cord is usually wrapped with adjacent turns spaced apart by a distance of only about 12 to 18 inches (about 30 to 45 cm).

Once the passages have been bored or cut in the caked fly ash, detonating cord may be wrapped about the boiler tubes. First, the detonating cord end is dropped between the tubes from an upper level to workers on a lower level. The detonating cord may either pass through space left by the fly ash between the tubes or through a hole rodded through the fly ash. Thereafter, the detonating cord end is pulled back up to the upper level using a tool, for example, a rod with a hoop on the end. The detonating cord is connected to the hoop and the rod is used to thread the detonating cord through a passage formed in the caked fly ash. After the slack is taken in, the process must be repeated many times. Should the downward path be too irregular, too narrow or too obstructed by fly ash, it may be necessary to thread the flexible detonating cord downwards through the bank of boiler tubes as well as upwards. Finally, the detonating cord is detonated to fracture the scale and fly ash and permit their removal from the tubes. It will be appreciated that the foregoing is a laborious and time-consuming operation resulting in significant downtime for the boiler and significant labor costs.

U.S. Pat. No. 5,056,587, issued to Jones et al, on Oct. 15, 1991 and entitled "Method For Deslagging a Boiler", discloses the rodding technique described above. FIG. 3B shows a cross-sectional view of a horizontal tubing array having a plurality of tubing panels with explosive detonating cord wrapped around the tubes. Detonation of the cords separates the ash from the tubing panels. As taught at column 8, lines 12–14 and 33–38, the detonating cords used are known flexible detonating cords requiring rodding and/or threading, using tools as discussed above, and are wrapped tightly about the banks of tubes.

U.S. Pat. No. 5,211,135, issued to Correia et al, on May 18, 1993 and entitled "Apparatus And Method Of Deslagging A Boiler With An Explosive Blastwave and Kinetic Energy", shows the use of highly flexible detonating cords in known methods of explosive deslagging. As seen in FIG. 1, bank 10 of boiler tubing panels 12 includes a plurality of spaced-apart links of boiler tube 14 held in place by spacer 16 (FIG. 4). The individual tubes 14 and panels 12 may be forty feet long. The boiler may comprise three hundred sets of tubing panels 12. Personnel referred to as "blasters" hand fashion a series of loops 20 of detonating cord (FIG. 2) into loop clusters 22 which are disposed between the tubing panels to provide explosive assemblies 28. This illustrates the very high flexibility of known detonating cord.

Atlas Corporation distributed in the United States special low-density explosives for pre-splitting and smooth blasting operations under the trade name KLEEN KUT™. The explosives were in 36-inch long cartridges which could be rigidly interconnected by couplers. The cartridges were offered with a minimum of 0.19 pounds of explosive per foot (about 1330 grains per foot) for use in pre-splitting, slope control, cushion blasting and smooth blasting and were manufactured with a special cartridge wrap to facilitate underground use.

The Assignee of this application also produces lead-sheathed detonating cords under the trademarks PRIMA-CLAD and PRIMASTICK. The lead sheath provides protection from hostile environments such as high temperatures encountered in oil field work. Lead, however, does not provide resiliency to the detonating cord and has additional disadvantages in certain applications. Metal-clad detonating cords are manufactured by filling a metal tube with explosive material and then subjecting the tube to a plurality of drawing (lengthening) steps. The process inherently involves the addition of substantial energy to the product, which increases the danger of manufacture. The finished metal-clad detonating cords are more difficult to initiate than plastic- and fabric jacketed cords. Initiation of metal clad detonating cords requires either higher output detonating cord, a special donor or special connectors to attach a donor cord across an exposed cut end of the metal clad cord. Furthermore, lead and other metal sheathings are extremely disadvantageous for use in cleaning of boiler tubes. Upon detonation, the metal may form shrapnel that can damage the surrounding structures, including the boiler tubes, which may suffer points of direct structural weakness or hot spots, resulting in long term degradation of the boiler tubes. Furthermore, substantial portions of the metal sheath may be vaporized and deposited on the tubes, again causing structural weaknesses or hot spots. Further still, the lead will adversely affect catalytic converters in the boiler exhaust stream and adversely impact the local environment. Finally, the ash collected from the tube cleaning process is customarily sold for ceramic use and metal contamination is undesirable. Thus, numerous disadvantages are known to arise from the use of the lead-sheathed detonating cord for deslagging a boiler, making their use unacceptable.

SUMMARY OF THE INVENTION

The present invention provides an improved reactive cord comprising a core of reactive material and a non-metal sheath produced using a continuous extrusion process surrounding the core, the improvement comprising that a six-foot length of the cord is sufficiently rigid to perforate fly ash.

The present invention also provides a reactive cord wherein the sheath comprises a material having a flexural modulus of about 250,000 psi ($17.236\times10^2$ MPa).

In another aspect, the present invention provides a cord comprising a core of reactive material and a non-metal sheath produced using a continuous extrusion process surrounding the core, wherein the cord is sufficiently rigid so that, when a six-foot length is supported horizontally at one end, the opposite end dips not more than about twelve inches from horizontal.

According to another aspect of the invention, the cord may comprise explosive material with a loading of less than 5000 grains per foot, optionally less than 1000 grains per foot, further optionally less than 500 grains per foot.

Optionally, the sheath of the cord may comprise an extruded jacket comprising one or more selected materials from the group consisting of: polystyrene, polycarbonate, polyamide, polyamide-imide copolymer, ethylene-chlorotrifluoroethylene copolymer (ECTFE) and acrylonitrile-butadiene-styrene (ABS) copolymer.

The sheath may comprise at least two layers including an innermost layer comprising a sealant jacket in contact with the reactive material and an outer jacket layer, which may comprise a plurality of longitudinally disposed reinforcing fibers.

According to one aspect of the invention, one end of the rigid cord is configured in the shape of a hook and comprises a shank, a return bend and a tip. This embodiment may be combined with a connector comprising a first hole and a second hole dimensioned and configured to receive the shank and the tip of the cord therethrough.

According to another aspect of the invention, the sheath may optionally have a noncircular cross-sectional configuration. Alternatively, it may have a wagon-wheel cross-sectional configuration.

This invention also has method aspects, such as a method of installing a reactive cord within a bank of boiler tubes caked with fly ash, comprising pushing the cord between the tubes to position the cord in the fly ash. In some instances pushing the cord may comprise perforating the fly ash with the cord. In other instances pushing may comprise pushing the cord upward through the tubes.

There is also a method of removing caked fly ash from a bank of tubes, comprising pushing a plurality of rigid reactive cords between the tubes to position the cords in the fly ash, and initiating the rigid cords. This method may comprise arranging a donor line in signal transfer relation to the rigid cords and initiating the donor line.

Further, there is a method for producing a rigid reactive cord comprising depositing a non-metal jacket over a flexible reactive cord which comprises a core of reactive material and a non-metal sheath. This method comprises depositing at least one additional non-metal jacket layer over the flexible cord in a continuous extrusion process to produce a cord having the rigidity described herein. Optionally, the additional jacket layer comprises a high modulus material. The method may comprise extruding the jacket over the flexible cord and cutting lengths of the jacketed cord during the extrusion process. The method may optionally comprise depositing a plurality of reinforcing fibers with the additional jacket layer.

Other methods of this invention include pushing a length of rigid detonating cord into a column of explosive material or into a bore hole.

DETAILED DESCRIPTION OF THE INVENTION AND PREFERRED EMBODIMENTS THEREOF

Figure 1A:
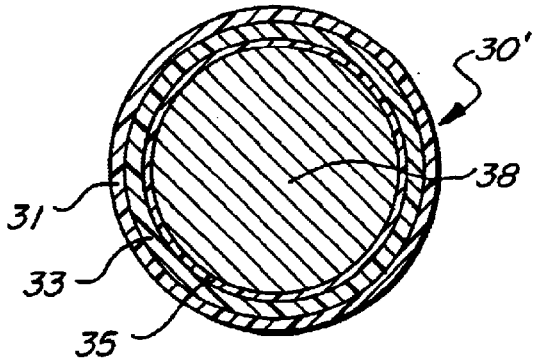
FIG. 1A ( PRIOR ART )
FIG. 1A is a cross-sectional view of a prior art detonating cord.

The invention provides a rigid reactive cord having a core of reactive material within a non-metal sheath. The cord of this invention comprises a sheath produced in a process which includes continuous extrusion steps of the type generally known in the art of the manufacture of detonating cord. The resulting product, however, is sufficiently more rigid than prior art non-metal-sheathed reactive cord to permit it to be pushed through a narrow or slightly irregular passage or to be pushed through (i.e., to penetrate or perforate) fly ash as part of a deslagging operation for a boiler or through another material to be fractured. Similarly, it is sufficiently rigid to permit its being pushed upwards, e.g., through a bank of boiler tubes. Therefore, in many circumstances the rigid cord of the present invention obviates the need in deslagging operations for rodding of fly ash and for threading of detonating cord through narrow or irregular passages. The rigidity of this product is demonstrated by supporting a six-foot length horizontally from one end and observing the degree to which the opposite end dips from horizontal. In a particular embodiment, the device was sufficiently rigid to exhibit a dip of only six inches. Other embodiments may dip to a greater or lesser degree under these conditions and it is believed that a dip of up to twelve inches will still indicate sufficient stiffness to distinguish the invention from prior art non-metal detonating cords. By comparison, a six-foot length of the prior art detonating cord PRIMACORD 400 bends downward to a substantially vertical orientation at a distance of about six to twelve inches from the horizontal end. Other, more flexible prior art detonating cords bend to the vertical orientation within even a smaller distance. A rigid cord according to the present invention will typically (but not necessarily) have a loading of reactive material of less than 5000 grains per foot, optionally less than 1000 grains per foot. Rigid detonating cord, according to the present invention, may have a core load of explosive material co-extensive with conventional detonating cords, e.g., anywhere from the smallest loading that will self-propagate to, e.g., 400 gr/foot or more. For use in initiating, blasting agents such as ANFO, or in smooth blasting, as described elsewhere herein, the loading may be equivalent to, e.g., about 188 or 470 gr/ft (about 40 or 100 g/m), respectively. Optionally, therefore, a rigid detonating cord, according to the present invention, may have a loading of explosive material of about 500 gr/ft or less.

This invention may also provide a rigid reactive cord which is sufficiently flexible to be able to bend when it encounters an obstruction in an irregular passageway but which is at the same time sufficiently rigid to avoid kinking or collapsing and thus allows its insertion by means of pushing without use of a tool.

In addition to use in cleaning banks of boiler tubes, the invention may be advantageously used in any application in which it is desirable to push a reactive cord through a perforatable substrate or through an irregular or narrow passageway. For example, this invention may be employed as the explosive in a pre-splitting operation, in which a single row of holes in a blast pattern are fired prior to the blasting of the rest of the holes in the pattern, to create cracks in the rock which delineate a smooth final contour for the blast. A rigid detonating cord of this invention can be inserted into the first row of holes to provide the explosive charge which creates the cracks. The rigid detonating cord of this invention may also be used in trim blasting, in which the rough walls remaining after a tunneling blast and excavation may be smoothed in a manner similar to pre-splitting, i.e., by drilling small diameter holes parallel to the tunnel wall with closely spaced center lines, pushing explosives through the holes and then detonating the explosives to leave a smoother tunnel wall. The explosive device of the invention may also be employed for blasting entrances through thin walls or doors, being used in a manner similar to conventional linear explosives i.e., by placing lengths of the cord on the wall in a predetermined configuration. The rigid detonating cord of this invention may also be inserted into a column of explosive such as ANFO (ammonium nitrate/fuel oil) in a bore hole to serve as an initiating charge.

In comparison to metal-sheathed explosive devices, the invention is also safer to manufacture as less energy is added to the explosive during its manufacturing process and does not produce shrapnel or metallic contaminants from the sheath.

Figure 1C:
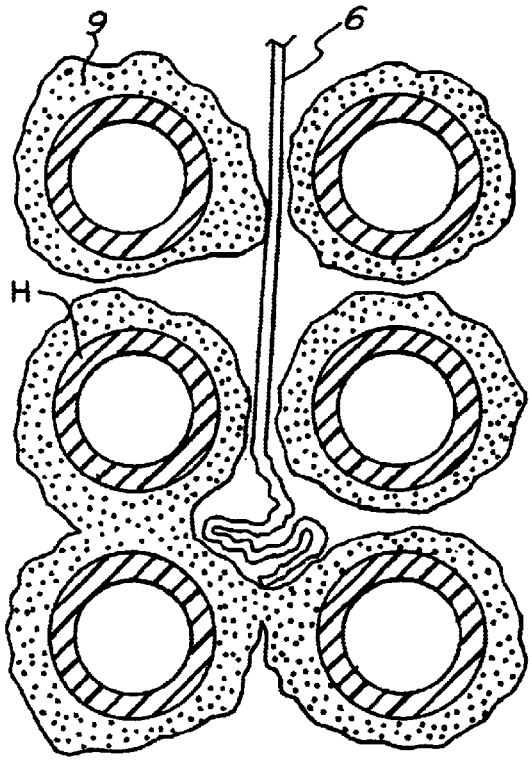
FIG. 1C is a cross-sectional view of a plurality of tubes encrusted with accumulated fly ash, showing a potential configuration of a conventional detonating cord lowered between the tubes without prior rodding or the use of an insertion device.
Figure 1D:
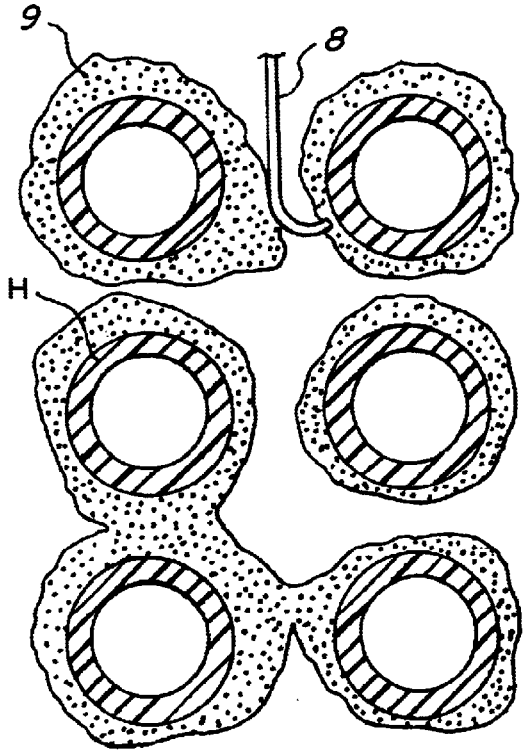
FIG. 1D is a cross-sectional view of a plurality of tubes encrusted with accumulated fly ash showing a possible configuration resulting from the attempted emplacement of a lead sheathed detonating cord between the tubing panels.
Figure 1B:
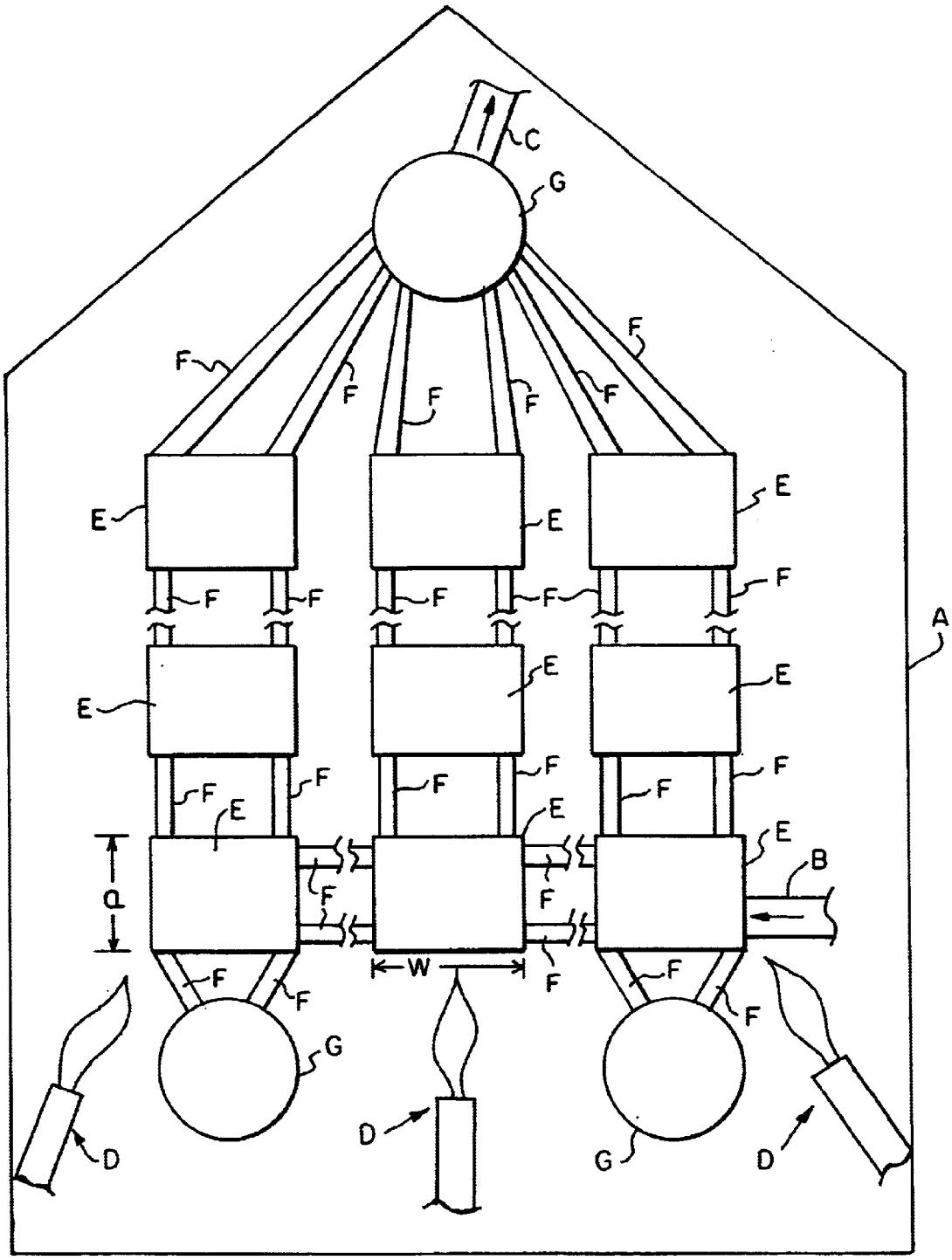
FIG. 1B is a schematic side elevation view of a steam generation plant having a plurality of banks of boiler tubes within which an embodiment of the present invention may be employed.

Referring now to FIG. 1B, a schematic representation of a steam generation plant is illustrated at A wherein there is contained a feed water pipe B and steam output line C. An energy source is located along the lower portion of structure A and may comprise a coal-fired series of burners generating a series of flames D. The feed water pipe B is connected to a bank of boiler tubes E that may be about 4 feet (about 1.2 m) deep (dimension a) and may be much longer, e.g., 10 to 20 feet (equivalent to about 3.1 to 6.2 m), (dimension w) although FIG. 1B does not reflect this proportion. Connector tubes F function to connect the banks of boiler tubes E together and to connect the banks of tubes with steam drums G. The steam drum G serves as a collector vessel for steam at the upper portion of structure A and another steam drum G serves for precipitation of solids at the lower portion of structure A. In operation, water enters the banks of boiler tubes E via the feed water pipe B. The water in tubes E is heated by flames D to generate steam which is output at the steam output line C.

The combustion of a fuel such as pulverized coal to produce flames D results in the generation of fly ash, as discussed above. Over time, fly ash, dust, etc., builds up and solidifies on the banks of boiler tubes E, thus insulating them from the flames D and reducing the efficiency of steam generation.

FIGS. 1C and 1D illustrate the expected results of attempts to employ prior art detonating cords to clean boiler tubes H encrusted with fly ash 9 without rodding. Caked fly ash 9 accumulates on pipes H until, in some places, passage therebetween is entirely blocked. A prior art detonating cord 6 (FIG. 1C) may be dropped easily from above through those areas in which the passage is not completely blocked. However, regardless of the density of caked fly ash 9, prior art detonating cord 6 lacks rigidity and will be unable to penetrate any obstructions and will bend and kink as illustrated without penetrating caked fly ash 9. This illustrates why rodding is necessary when using conventional detonating cord. In addition, some sort of tool must be used to return the detonating cord 6 upward through tubes H.

FIG. 1D illustrates a hazard of using a prior art metal sheathed detonating cord. Metal sheathed detonating cord 8 may become bent when being inserted through passages in caked fly ash or hardened scale 9. As the metal has no memory, the bend will remain in the cord and will quickly cause the metal sheathed detonating cord 8 to snag on a facing surface, begin threading itself in the wrong direction, or simply jam. This is in addition to the numerous disadvantages noted previously regarding the use of metal sheathed detonating cords inside of steam plants.

Figure 2A:
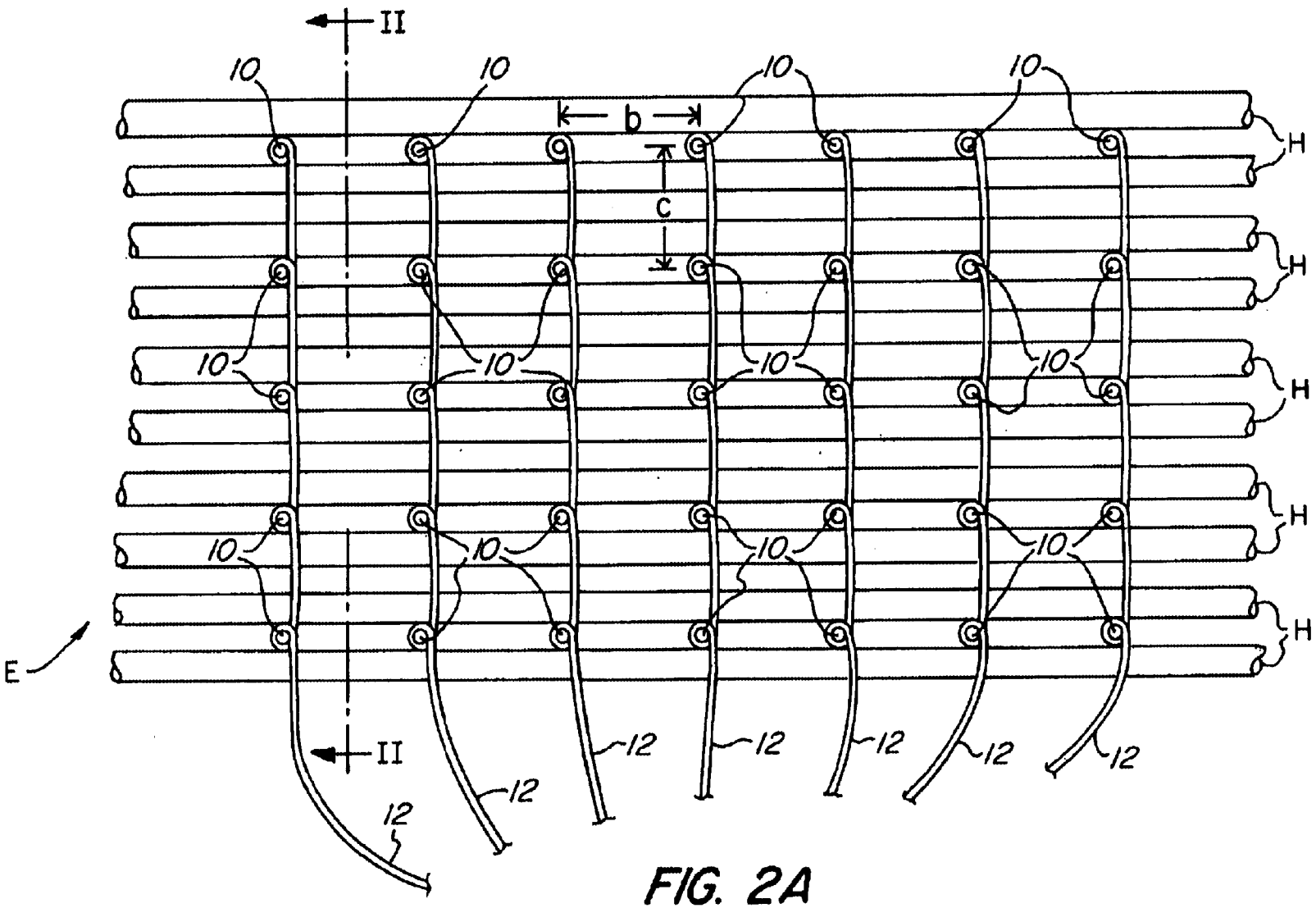
FIG. 2A is a partial plan view of a bank of boiler tubes having fly ash disposed thereon and between which rigid detonating cords are disposed in accordance with an embodiment of the present invention.
Figure 2B:
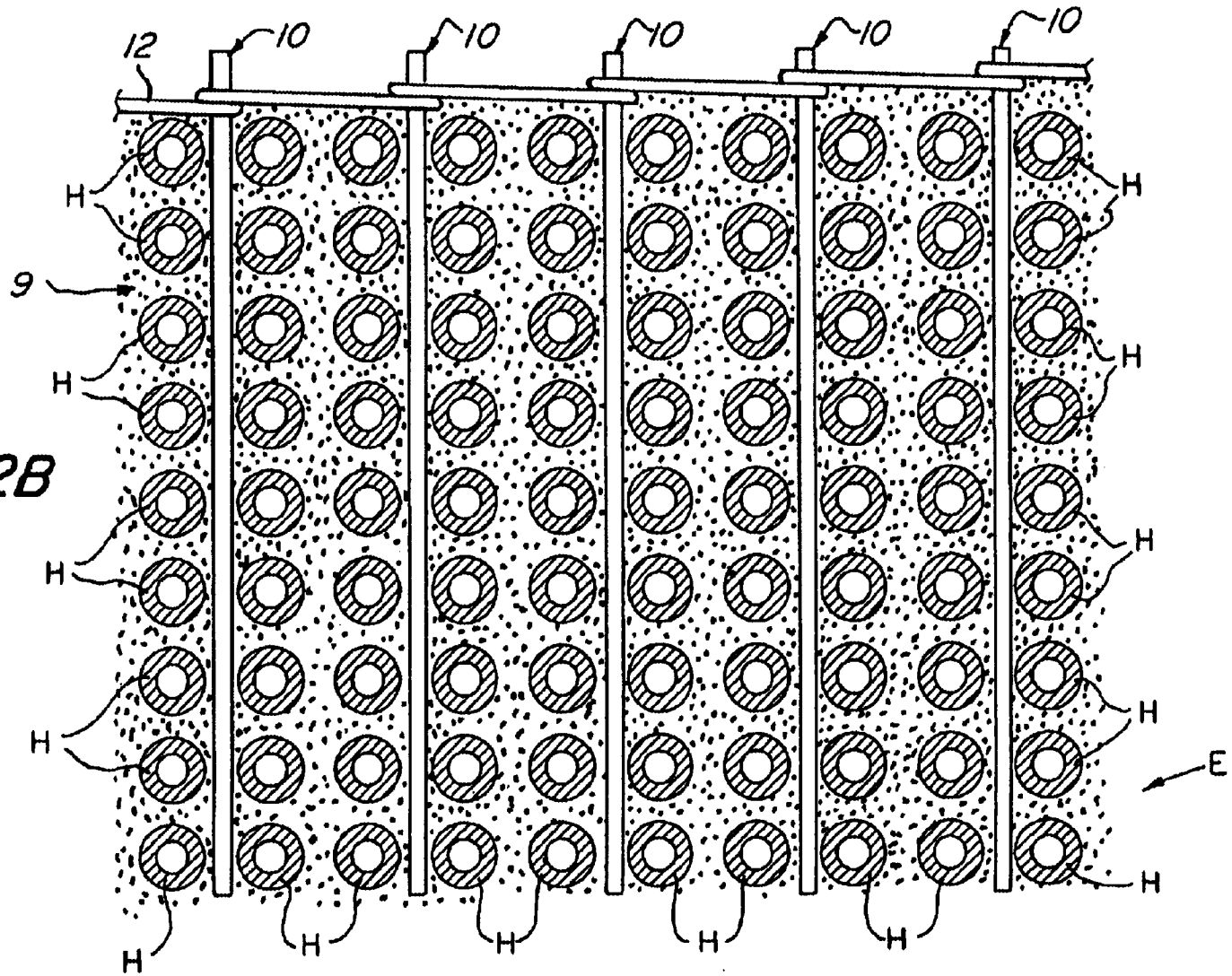
FIG. 2B is a cross-sectional view of the bank of boiler tubes of FIG. 2A taken along line II—II.

Turning to the present invention, a plurality of rigid detonating cords are each illustrated generally at 10 in FIGS. 2A and 2B. FIG. 2A is a plan view of a bank of boiler tubes of the steam plant of FIG. 1B. Thus, rigid detonating cords 10 are seen "end on" in FIG. 2A within loops formed in flexible donor lines 12. Each donor line 12 (FIG. 2A and FIG. 2B) may comprise a conventional flexible detonating cord and may be secured to the end of each rigid detonating cord 10 in a clove hitch. Other ways of connecting the donor line 12 with the rigid detonating cord 10 for transfer of an initiation signal therebetween may be employed, however, as will be discussed further below. One example of a conventional detonating cord suitable for this purpose is sold by The Ensign-Bickford Company under the trademark PRIMACORD. A donor line core loading which has been found suitable for use in this embodiment may be approximately 25 to 50 grains/foot (about 5.31 g/m to 10.6 g/m) of PETN, although it will be understood that any suitable core loading may be employed. FIG. 2B is a cross-sectional view taken along line II—II of FIG. 2A and thus shows rigid detonating cord 10 in elevation view. As shown in these Figures, the rigid detonating cord 10, the composition of which is discussed in more detail below, are disposed within a bank of boiler tubes E (FIG. 1B). The bank E of boiler tubes H contains numerous single tubes H disposed in a parallel fashion. Each tube H may be approximately 3.5 inches (about 8.9 cm) in diameter and there may be 1.5 to 2 inches (about 3.8 cm to 5.1 cm) of space between tubes. As discussed above, each tube H is covered by caked fly ash 9 which is to be removed by detonation of the rigid detonating cord 10.

In order to prepare for the removal of the fly ash and scale on tubes H, an operator may insert one or more rigid detonating cords 10 by hand between the boiler tubes H and through the caked fly ash 9 where the latter is of sufficiently low density. As discussed above, this procedure is only possible because of the invention. In addition, in the event that there is an opening in the scale and fly ash 9 the elongate rigid detonating cord 10 may be inserted into the opening. In addition, it is not necessary for one member of the team to position themselves below the bank of boiler tubes E in order to return the detonator cord to the team member on top of the boiler tubes using a pole. The method-of-use of the invention is carried out without wrapping the explosive around the bank of tubes. No return is necessary, so all work may be conducted from the top of the boiler tubes, thus eliminating the more difficult half of the labor requirement. The rigid detonating cord 10 may then be connected to a plurality of donor lines 12. For removal of caked fly ash from boiler tubes where the dimensions b and c (FIG. 2A) between rigid detonating cords 10 are approximately 12 inches to 18 inches (about 30.5 cm to 45.7 cm), a core loading equivalent to between about 40 and 70 grains per foot (from about 8.5 g/m to 14.9 g/m) of the explosive PETN may be employed, although about 55 grains per foot (about 11.7 g/m) has been found to be most suitable. The rigid detonating cords 10 are initiated by a signal carried by donor lines 12.

Figure 2C:
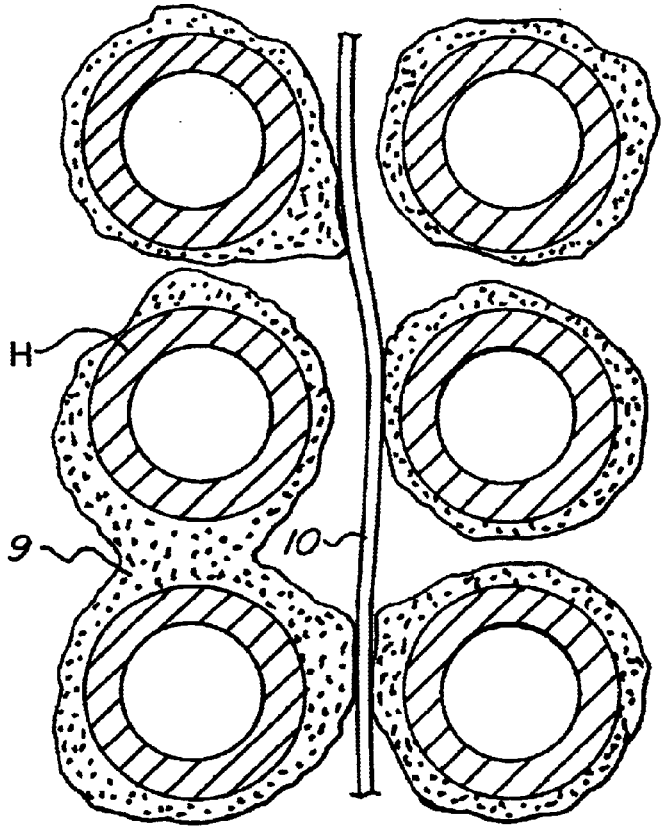
FIG. 2C is a cross-sectional view of boiler tubes encrusted with accumulated fly ash with a rigid detonating cord according to the present invention positioned therein.

FIG. 2C illustrates the positioning of rigid detonating cord 10 in the scale and fly ash 9 between tubes H according to the present invention. Rigid detonating cord 10 may encounter irregularities in the passages between fly ash 9, however, its rigidity and resilience permits the user to push it through soft fly ash and enables it to be deflected by hardened scale and to proceed toward the bottom of the tube bank without rodding. Accordingly, much time is saved compared to the rodding and threading procedure required by the use of flexible prior art explosive detonating cords.

Figure 3A:
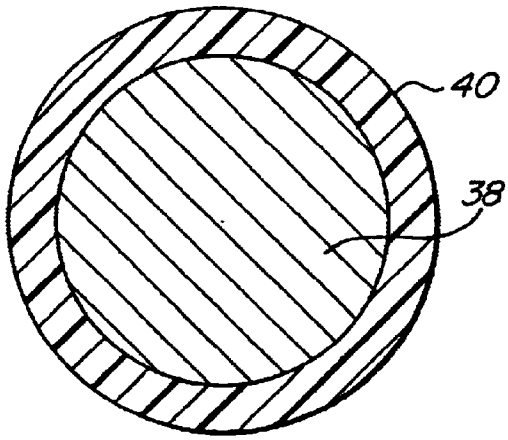
FIG. 3A is a schematic cross-sectional view of a rigid detonating cord in accordance with the present invention.

A rigid detonating cord 10 in accordance with a particular embodiment of the present invention is schematically represented in FIG. 3A as comprising a core 38 of explosive material and a non-metal sheath 40.

The core 38 comprises any conventional material used in detonating cord as described above, such as RDX or PETN so that upon initiation the device yields a shock wave. Alternatively, the core may comprise deflagrating substance so that upon initiation the device yields a non-explosive pressure pulse. Explosive materials and deflagrating materials are collectively referred to herein as "reactive materials", and cords containing cores of either explosive or deflagrating materials are referred to as "reactive cords".

Sheath 40 may comprise a single jacket layer about core 38 or, more typically, it may comprise a plurality of jacket layers which may comprise a variety of materials, e.g., sheath 40 may comprise one or more extruded polymeric layers and/or textile layers. In addition, there may be reinforcing fibers or yarns between the layers or, as described herein, reinforcing fibers may be embedded within another layer material. These jacket layers may be disposed over core 38 in conventional manners, e.g., extrusion of a jacket layer over the core or the weaving of a textile sleeve about the core. The layers may be applied about the core in one or more continuous processing steps in which the product is passed through an extrusion die or weaving apparatus and is collected onto a spool before being subjected to a subsequent processing step to apply the next jacket layer. Generally, sheath 40 will comprise at least two jacket layers: a thin sealant jacket layer, which is in direct contact with core 38 and which is co-extruded therewith, and at least one other jacket layer.

Whatever the construction of cord 10, it differs from prior art detonating cord with nonmetal sheaths in its degree of rigidity. Such rigidity may be attained, by choice of the materials used in the sheath and/or by the thickness or number of jacket layers disposed about the core, even if conventional jacket materials are used.

One way of identifying jacket materials which lend greater rigidity to detonating cord than conventional materials is by their flexural modulus as determined by the standard testing method ASTM D790 established by the American Society for Testing and Materials, West Conshohocken, Pa. Briefly summarized, testing method D790 pertains to the determination of flexural properties of un-reinforced and reinforced plastics. According to one version of this test method, each of at least five bars of rectangular cross-section measuring 127×12.7×3.2 mm is placed on two supports and is loaded by means of a loading nose midway between the supports. A support span-to depth ratio of 16 to 1 should be used. The specimen is deflected under a strain ($\epsilon_f$) rate of 0.01 mm/mm/min (millimeter per millimeter per minute) until rupture occurs in the outer surface of the test specimen or until a strain of 5% is reached whichever occurs first. The stress at these end points of the test may be calculated in accordance with the following equation:

$$\sigma_f = 3\ PL/2bd^2.$$

The test is carried out in standard laboratory atmosphere conditions of 23° C. temperature plus or minus 2° C. and 50% relative humidity plus or minus 5%. Strain is measured as the ratio of the degree of deflection at the time of measurement to the distance between the supports. The flexural modulus (FM) may be calculated as:

$$F.M. = \sigma_f/\epsilon_f$$

The material used in a jacket layer for its stiffness may have a flexural modulus of, e.g., about 250,000 psi, (about 17.236×102 MPa), which is higher than the modulus of conventional sheath materials. It will be appreciated that the ignition temperature of the energetic material discussed above should be considered for safety reasons when choosing a jacket material, i.e., the melting point of the jacket material is preferably lower than that of the core.

One suitable high modulus jacket material for use in sheath 40 is high impact polystyrene. Polystyrene is particularly advantageous for use over a core comprising PETN because polystyrene melts at a temperature of approximately 280° F., which is below the ignition temperature of PETN (approximately 300° F.). Other high modulus materials suitable for a jacket of sheath 40 include polycarbonate, polyamide, polyamide-imide copolymer, acrylonitrile-butadiene-styrene (ABS) copolymer and various fluoropolymers. In contrast, extruded jacket materials on prior art detonating cord typically comprise low-density polyethylene and/or polyvinyl chloride.

Another material which has a flexural modulus of approximately 250,000 psi and which may be used for the sheath is ethylene-chlorotrifluoroethylene copolymer (ECTFE) such as that sold by the Ausimont Corporation under the trademark HALAR. ECTFE has a melting point of approximately 500° F. and thus is advantageous for use in high temperature environments, for example, in the event it is desired to clean boiler tubes prior to the cooling thereof. When such ECTFE is used for the sheath, HMX is preferred for the core explosive material.

Figure 3B:
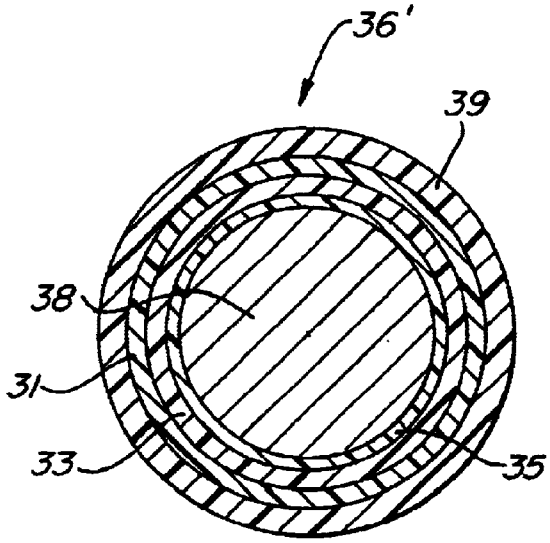
FIG. 3B is a cross-sectional view of one specific embodiment of a rigid detonating cord according to the present invention.

As indicated above, sheath 40 may comprise a single layer of material about core 30 but, more typically, sheath 40 will comprise a plurality of jacket layers of material. For example, core 30 is typically co-extruded with a thin protective jacket layer to facilitate handling in at least one subsequent jacketing process in which the jacketed core is passed through an extrusion die or a weaving device to apply another jacket layer thereto to achieve the desired rigidity. One such method of producing a rigid detonating cord in accordance with the present invention is to start with a conventional flexible detonating cord which already comprises one or more jacket layers, and then extruding around it one or more additional jacket layers which, by virtue of their material and/or physical configuration, render the product rigid. (Such additional jacket layers are sometimes referred to herein as "stiffening" jacket layers.) Thus, a detonating cord such as that shown in FIG. 1A, or as otherwise known in the art, could be passed through the extrusion die to provide the core of explosive material. At least one additional jacket layer 39 (FIG. 3B) may then be extruded onto the detonating cord to form a rigid detonating cord 36'. Optionally, the material in an additional stiffening jacket layer may have a flexural modulus of about 250,000 psi (17.236×102 MPa). After extrusion of the stiffening jacket over the core, the jacket material cools and imparts the desired rigidity to the explosive device. Typically the product is too rigid to collect on a spool so the desired lengths of the explosive device are cut from the continuous extrusion output for linear handling and packaging. One particular embodiment of rigid detonating cord has an outer diameter of 0.280 inch, an outer jacket comprising high impact polystyrene at a thickness of 0.065 inch extruded about the detonating cord of FIG. 1A, wherein the core has a core loading of 55 grains PETN per foot (11.7 grams per meter) and a diameter of 0.150 inch and the rigid detonating cord has a total jacket weight of 125 grains per foot (26.575 grams per meter). Another specific embodiment comprises a core comprising RDX at a loading of 85 grains per foot, a braided jacket of polyester yarn weighing 15 grains per foot and a nylon outer jacket weighing about 35 grains per foot.

A typical embodiment of boiler cord has a loading of explosive material of 100 grains per foot or less, but greater loadings can be used in appropriate circumstances as will be recognized by one of ordinary skill in the art.

Figure 3C:
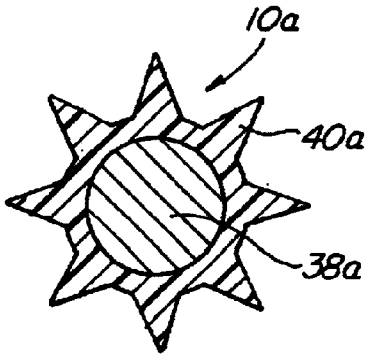
FIGS. 3C, 3D and 3E are cross-sectional views showing various configurations of reactive cord in accordance with various embodiments of the present invention.
Figure 3D:
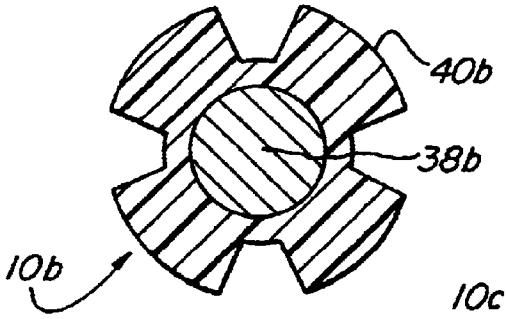
Figure 3E:
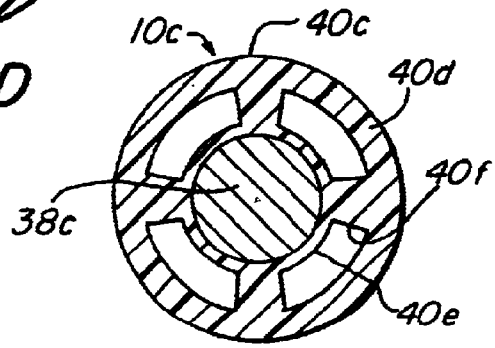

In other embodiments of the invention, the rigidity of the explosive device may be achieved in ways beside, or optionally in addition to, the use of high modulus plastic jacket materials. For example, as described above, the rigidity of an otherwise flexible detonating cord can be enhanced by adding one or more other layers of textile or extruded material in addition to whatever other layers it may already have, the additional layers optionally comprising high modulus materials. Also, the extrusion temperature of an extruded jacket material may be lower than normal in order to increase the stiffniess of the final product. Another option is to select a cross-sectional configuration for the cord which increases its rigidity. For example, the core and/or the jacket may have a star cross section, e.g., cord 10*a*, FIG. 3C, has a star-shaped sheath 40*a* about core 38*a*, or other non-circular cross-section, e.g., cord 10*b* has a toothed cross-sectional sheath 40*b* about core 38*b*. Alternatively, a jacket layer having a "wagon wheel" cross-section will provide rigidity, e.g., cord 10*c* has a wagon wheel cross-sectional sheath 40*c* having a first annular layer 40*d* and a second annular layer 40*e* connected thereto by radial supports 40*f*.

Figure 4:
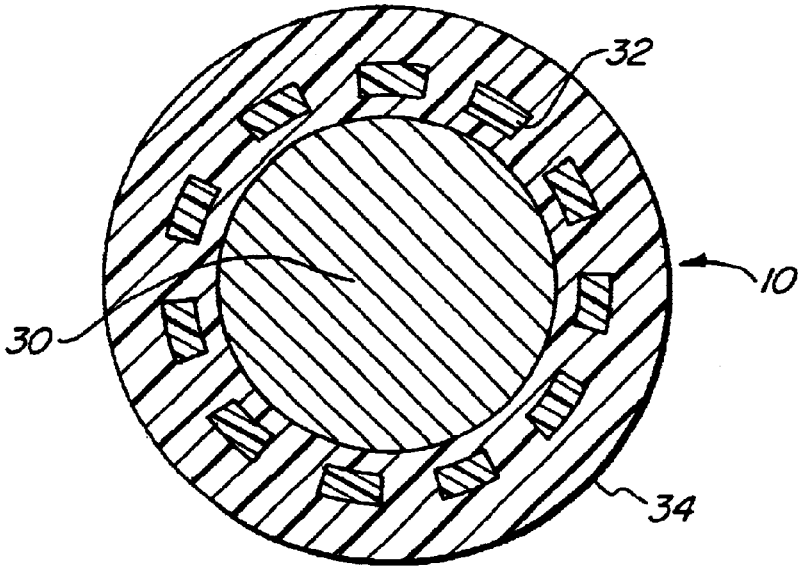
FIG. 4 is a cross-sectional view of a rigid detonating cord in accordance with another specific embodiment of the present invention.

FIG. 4 illustrates another way to provide rigidity to an explosive device comprising an explosive core in a non-metal sheath: the embedding of supporting fibers within an extruded jacket layer. In this embodiment, detonating cord 10 comprises a core 30 of explosive material and a non-metal sheath comprising a stiffening jacket layer 34 extruded about the core 30. There is a plurality of fibers 32 embedded longitudinally within jacket layer 34 to stiffen the jacket and therefore render the finished product rigid. Depending on what degree of rigidity is needed, jacket layer 34 may comprise a high flexural modulus material or a conventional jacket material. Fibers 32 may comprise high-tensile polymeric materials such as a polyamide or polyester fiber. In an alternative embodiment, four strands of apolyamide fiber such as poly(p-phenylene terephthalamide) (Kevlarm# yarn) may be applied to the cord circumference at a 90° radial spacing within the extruded jacket corresponding to jacket 34. If sufficient rigidity is provided by the reinforcing fibers, the material of jacket 34 need not comprise a high modulus material.

Figure 5A:
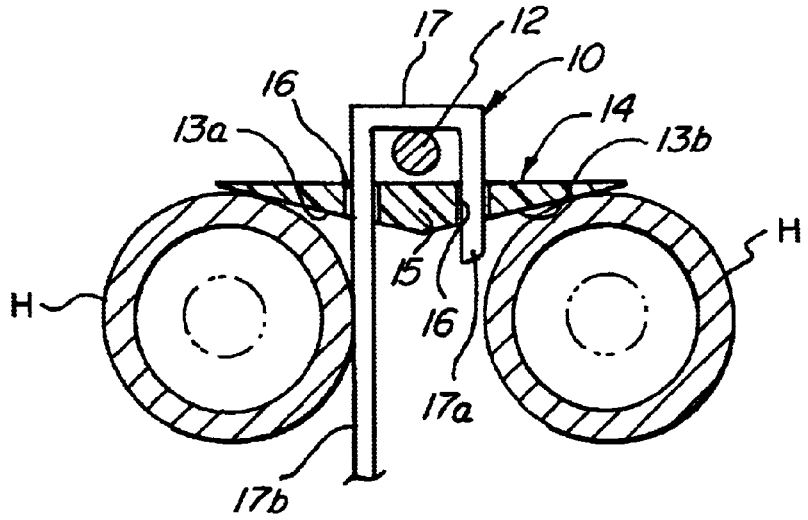
FIG. 5A is a side elevational view of a connector device in accordance with an embodiment of the present invention mounted between two boiler tubes for connecting a rigid explosive device of the present invention and a donor line.
Figure 5B:
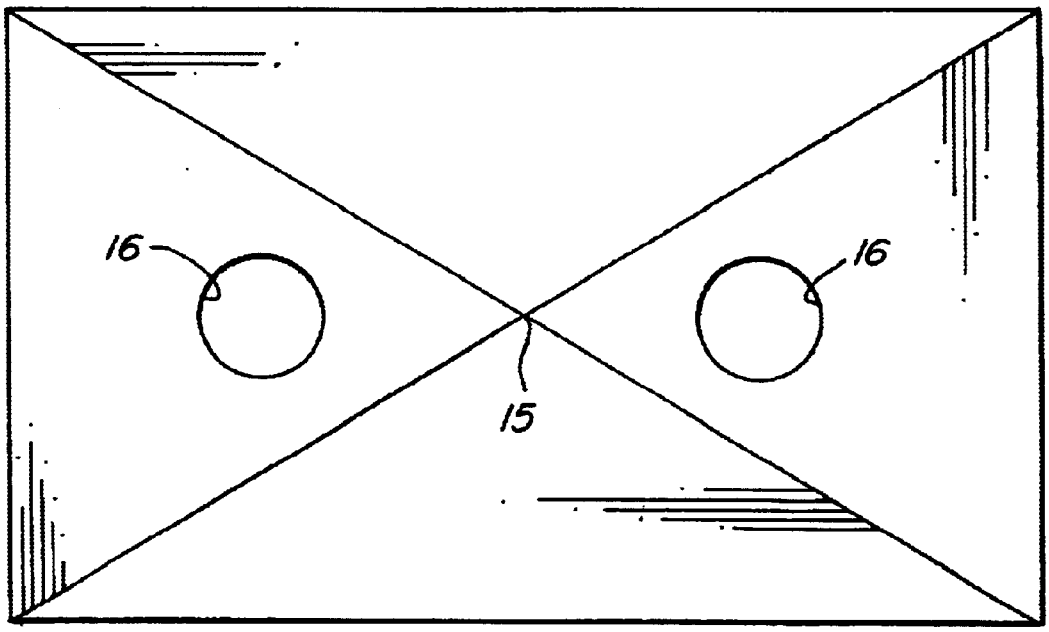
FIG. 5B is a bottom view of the connector device shown in FIG. 5A.

FIGS. 5A and 5B illustrate a connector 14 for connecting the donor line 12 in signal transfer relationship with a rigid detonating cord 10. The connector 14 is molded from a nonmetal material and is long enough to lay across two adjacent boiler tubes. At least two side surfaces 13*a* and 13*b* define the triangular bottom surface of connector 14, which assists in the mounting of the connector 14 on top of the boiler tubes H as the center of gravity of the . connector 14, indicated generally at 15, may be easily centrally located therebetween. The connector 14 comprises a pair of apertures 16. In this embodiment, one end of rigid detonating cord 10 comprises a hook portion having a return bend 17 by which first end 17*a* is directed towards the other end (not shown). The remainder of rigid detonating cord 10 comprises a shank 17*b* on which bend 17 is formed. In use, connector 14 is laid across two adjacent tubes H and donor line 12 is laid across the top of connector 14. Shank 17*b* and tip 17*a* are passed through holes 16 so that rigid detonating cord 10 hangs from connector 14 with donor line 12 in signal transfer relation to rigid detonating cord 10 at return bend 17. This assembly provides sufficient contact between the rigid detonating cord 10 and the donor line 12 for initiation of the rigid detonating cord 10, and makes for easier handling and placement of the rigid detonating cord 10 as well as easier connection to donor line 12.

Figure 6A:
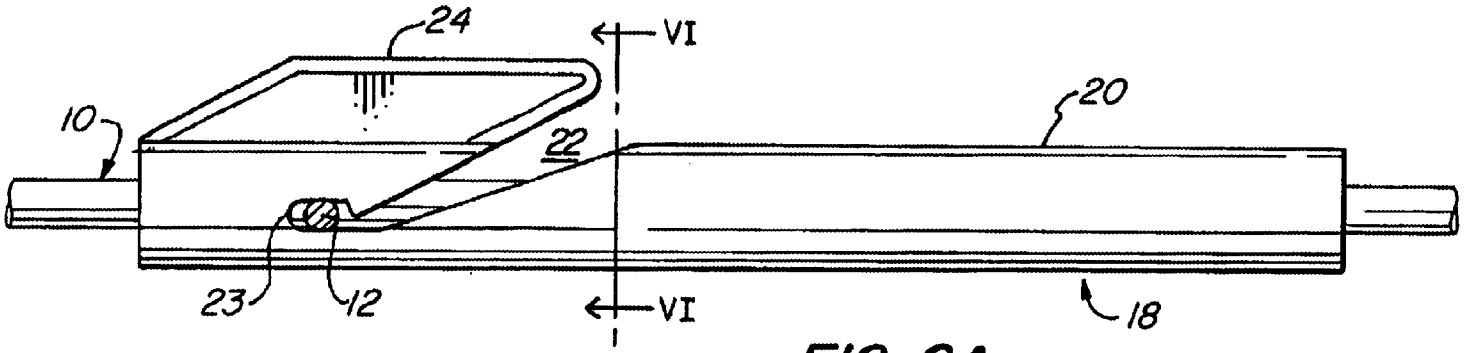
FIG. 6A is a side elevational view of a connector device in accordance with another embodiment of the present invention for connecting a rigid explosive device of the present invention and a donor line.
Figure 6B:
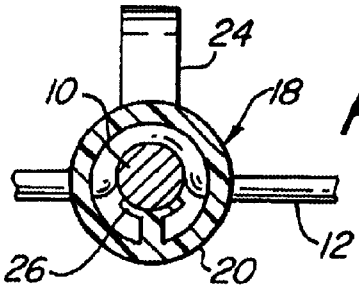
FIG. 6B is a cross-sectional view taken along line VI—VI of FIG. 6A.
Figure 6C:
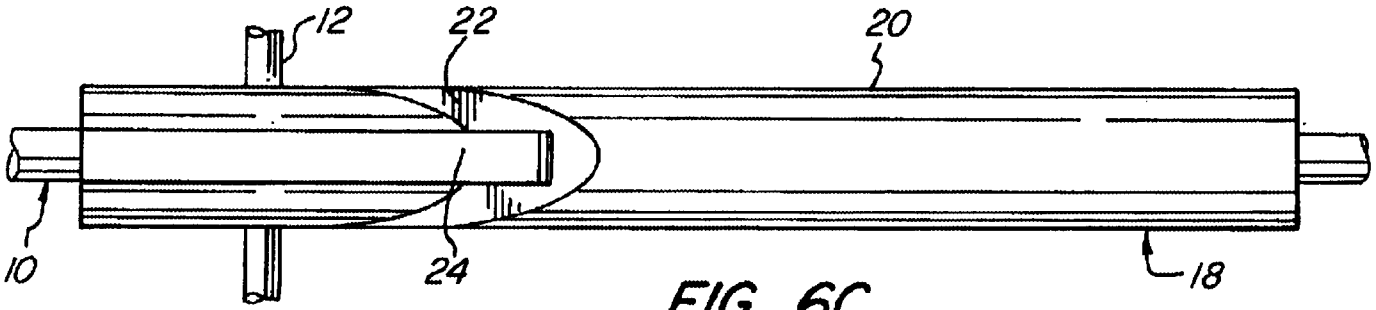
FIG. 6C is a plan view of the embodiment of FIG. 6A.

Another embodiment of a connector is shown generally at 18 in FIGS. 6A through 6C. The connector 18 may also be composed of a plastic and comprises a generally tubular body 20, a receiving slot 22 and a stiffening fin 24. The tubular body 20 comprises an axially extending support member 26 (FIG. 6B) for supporting the rigid detonating cord 10 axially through the body 20. The receiving slot 22 extends partially through the body 20 and terminates in a recess 23 (FIG. 6A) for receiving a donor line 12. As seen in FIG. 6B, the donor line 12 conforms and partially wraps around the rigid detonating cord 10 such that a signal may be transmitted from the donor line 12 to the rigid detonating cord 10.

During assembly, the rigid detonating cord 10 may be inserted through the body 20 of the connector 18. Thereafter, a donor line 12 may be inserted into receiving slot 22 until it is disposed within the recess 23, between resilient detonating cord 10 and the stiffening fin 24. In this way, the donor line 12 is disposed in conforming relation to the outer circumference of the rigid detonating cord 10.

The rigid detonating cord of the present invention provides an advantage over the use of conventional, non-rigid detonating cord for use in the removal of fly ash from boiler tubes because it reduces the need for "rodding" the fly ash and eliminates the need to use a tool to thread the detonating cord through a rodded passage in the fly ash or to thread the cord upward through the tubes. In addition, the present invention provides an economic advantage in that a given bank of boiler tubes can be deslagged with a smaller volume of product. For example, it has been estimated that the cleaning of a boiler for a 450–500 megawatt plant requires a total of about 40,000 feet of prior art detonating cord. The cleaning process requires three passes using about 13,333 feet each. In contrast, the same degree of cleaning can be achieved by using the rigid detonating cord of the present invention with, on average, about half the number of passes required using conventional detonating cord. Furthermore, in each pass, about 14% less rigid detonating cord (measured on a linear basis) is required compared to conventional detonating cord. Furthermore, the cleaning can be accomplished with a smaller team of personnel in the same or a lesser time.

While the invention has been described in detail with respect to particular embodiments thereof, it will be apparent that upon a reading and understanding of the foregoing, numerous alterations to the described embodiments will occur to those skilled in the art and it is intended to include such alterations within the scope of the present invention.

What is claimed is:

1. A reactive cord comprising a non-metal sheath produced using a continuous extrusion process and having a core of reactive material therein at a loading sufficient to enable the cord to yield one of a detonation shock wave and a pressure pulse, and wherein the cord is sufficiently rigid to permit a six-foot length of the cord to be pushed upward through a bank of boiler tubes.

2. The cord of claim 1 wherein the sheath comprises a material having a flexural modulus of about 250,000 psi ($17.236\times10^2$ MPa).

3. A reactive cord comprising a non-metal sheath produced using a continuous extrusion process and having a core of reactive material therein at a loading sufficient to enable the cord to yield one of a detonation shock wave and a pressure pulse, and wherein the cord is sufficiently rigid so that when a six-foot length is supported horizontally at one end the opposite end dips not more than about twelve inches from horizontal.

4. The cord of claim 1, claim 2 or claim 3 wherein the sheath comprises an extruded jacket comprising one or more materials selected from the group consisting of: polystyrene, polycarbonate, polyamide, polyamide-imide copolymer, ethylene-chlorotrifluoroethylene copolymer (ECTFE) and acrylonitrile-butadiene-styrene (ABS) copolymer.

5. The cord of claim 1, claim 2 or claim 3 having a core loading of explosive material of less than 1000 grains per foot.

6. The cord of claim 5 having a core loading of explosive material of less than about 500 grains per foot.

7. The cord of claim 5 wherein the sheath comprises an extruded jacket comprising one or more materials selected from the group consisting of: polystyrene, polycarbonate, polyamide, polyamide-imide copolymer, ethylene-chlorotrifluoroethylene copolymer (ECTFE) and acrylonitrile-butadiene-styrene (ABS) copolymer.

8. The cord of claim 1, claim 2 or claim 3 wherein the sheath comprises at least two layers including an innermost layer comprising a sealant jacket in contact with the reactive material and an outer jacket layer and wherein the sheath comprises a plurality of longitudinally disposed reinforcing fibers.

9. The cord of claim 1 or claim 3 wherein one end of the cord is configured in the shape of a hook and comprises a shank, a return bend and a tip.

10. The cord of claim 9 in combination with a connector comprising a first hole and a second hole dimensioned and configured to receive the shank and the tip of the cord therethrough.

11. The cord of claim 10 wherein the shank and the tip are received in the first and second holes in the connector.

12. The cord of claim 9 wherein the core comprises an explosive material.

13. The cord of claim 1 or claim 3 wherein the sheath has a non-circular cross-sectional configuration.

14. The cord of claim 1 or claim 3 wherein the sheath has a wagon wheel cross-sectional configuration.

15. A reactive cord consisting essentially of a core of reactive material and a non-metal sheath surrounding the core, the cord having a core loading of reactive material sufficient to enable the cord to yield one of a detonation shock wave and a pressure pulse wherein a six-foot length of the cord is sufficiently rigid to permit the cord to be pushed upward through a bank of boiler tubes.

16. The cord of claim 15 wherein the sheath comprises a material having a flexural modulus of about 250,000 psi ($17.236\times10^2$ MPa).

17. A reactive cord consisting essentially of a core of reactive material and a non-metal sheath surrounding the core, the cord having a core loading of reactive material sufficient to enable the cord to yield one of a detonation shock wave and a pressure pulse wherein the cord is sufficiently rigid so that when a six-foot length is supported horizontally at one end the opposite end dips not more than about twelve inches from horizontal.

18. The cord of claim 15, claim 16 or claim 17 having a core loading of explosive material of less than 1000 grains per foot.

19. The cord of claim 18 having a core loading of explosive material of less than about 500 grains per foot.

20. The cord of claim 15, claim 16 or claim 17 wherein the sheath comprises at least two layers including an innermost layer comprising a sealant jacket in contact with the reactive material and an outer jacket layer and wherein the sheath comprises a plurality of longitudinally disposed reinforcing fibers.

21. The cord of claim 15, claim 16 or claim 17 wherein one end of the cord is configured in the shape of a hook and comprises a shank, a return bend and a tip.

22. The cord of claim 21 in combination with a connector comprising a first hole and a second hole through which the shank and the tip of the cord are received.

23. In a reactive cord comprising a core of reactive material and a non-metal sheath produced using a continuous extrusion process surrounding the core, the improvement comprising that a six-foot length of the cord is sufficiently rigid to perforate fly ash, wherein one end of the cord is configured in the shape of a hook and comprises a shank, a return bend and a tip.

24. The cord of claim 23 in combination with a connector comprising a first hole and a second hole dimensioned and configured to receive the shank and the tip of the cord therethrough.

25. The cord of claim 24 wherein the shank and the tip are received in the first and second holes in the connector.

26. The cord of claim 23 wherein the core comprises an explosive material.

27. A reactive cord consisting essentially of a core of reactive material and a non-metal sheath surrounding the core, wherein a six-foot length of the cord is sufficiently rigid to perforate fly ash wherein one end of the cord is configured in the shape of a hook and comprises a shank, a return bend and a tip.

28. The cord of claim 27 in combination with a connector comprising a first hole and a second hole through which the shank and the tip of the cord are received.

29. The cord of any one of claims 1, 3, 17, 23 and 27 wherein the sheath comprises a synthetic polymeric material.

* * * * *